United States Patent [19]

Bleckmann

[11] Patent Number: 5,020,128

[45] Date of Patent: May 28, 1991

[54] TUBULAR SHEATHED ELECTRIC HEATER WITH AN OVERHEAT SAFETY DEVICE

[76] Inventor: Ingo Bleckmann, Ignaz-Rieder-Kai 11, A-5020 Salzburg, Austria

[21] Appl. No.: 278,114

[22] Filed: Nov. 30, 1988

[30] Foreign Application Priority Data

Nov. 30, 1987 [DE] Fed. Rep. of Germany ... 8715851[U]

[51] Int. Cl.[5] ..... H05B 1/02; H05B 3/82; H01H 37/32

[52] U.S. Cl. ..... 392/498; 219/512; 219/517; 219/523; 219/544; 337/393; 337/403; 337/416; 392/451; 392/455

[58] Field of Search ..... 219/331, 328, 335, 336, 219/512, 544, 517; 337/403–416, 393; 392/498, 451, 455

[56] References Cited

U.S. PATENT DOCUMENTS

| | | | |
|---|---|---|---|
| 1,582,276 | 4/1926 | Kitto | 337/409 |
| 1,689,198 | 10/1928 | Gagelman | 219/331 |
| 2,066,632 | 1/1937 | Lovekin et al. | 337/411 |
| 3,043,937 | 7/1962 | Milton et al. | 337/405 |
| 3,371,192 | 2/1968 | Rosenel | 219/331 |
| 3,585,359 | 6/1971 | Drugmand | 219/331 X |
| 4,075,595 | 2/1978 | Plasko | 337/403 X |
| 4,384,267 | 5/1983 | Aoki | 337/407 |
| 4,390,776 | 6/1983 | Yane | 219/544 X |
| 4,675,642 | 6/1987 | Reiferscheid | 337/393 X |
| 4,697,069 | 9/1987 | Bleckmann | 219/517 |

FOREIGN PATENT DOCUMENTS

| | | | |
|---|---|---|---|
| 86465 | 8/1983 | European Pat. Off. | 219/331 |
| 204850 | 12/1986 | European Pat. Off. | 219/331 |
| 1125567 | 3/1962 | Fed. Rep. of Germany | 219/331 |
| 2098436 | 11/1982 | United Kingdom | 219/331 |

*Primary Examiner*—Anthony Bartis

*Attorney, Agent, or Firm*—Fleit, Jacobson, Cohn, Price, Holman & Stern

[57] ABSTRACT

A tubular electric resistance heater includes a tubular sheath enclosing an electric heater coil. As protective overheat safety device is provided at an end of the sheath and includes an electrically conductive tube disposed in a cavity in the end of the sheath and having a closed end electrically connected to the heater coil. A rod-shaped member made of a thermally deformable material extends through the tube from the closed and projects out of the other end of the tube into activating engagement with a normally closed switch located externally of the tubular sheath and electrically connected in series with the tube and thereby the heater coil. Excessive heater coil temperatures cause the rod-shaped member to deform and actuate the switch to its open position to deenergize the heater coil. The rod-shaped member may be made to a memory-alloy or a plastic which changes its structure, e.g., shrinks, or melts at a certain temperature.

2 Claims, 8 Drawing Sheets

Figure 1:
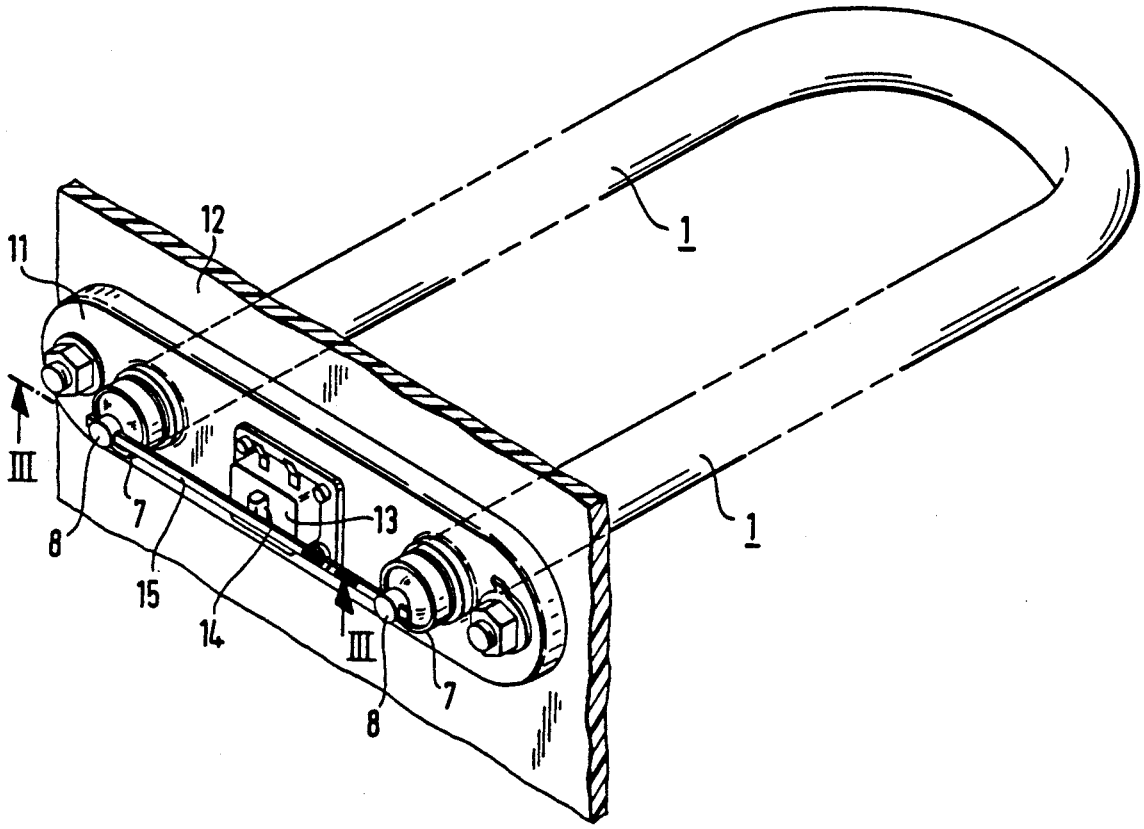

Fig. 3
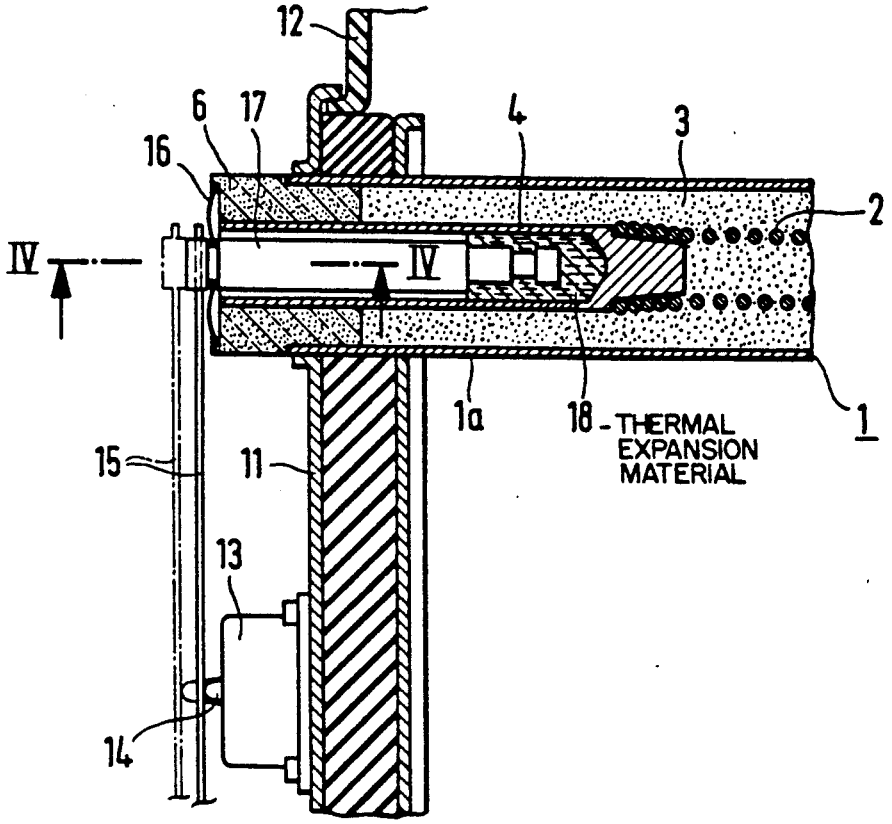
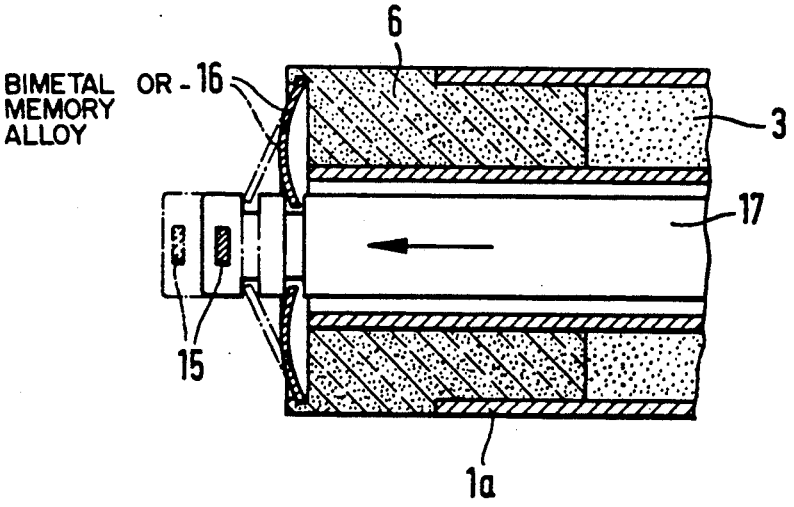
Fig. 4

TUBULAR SHEATHED ELECTRIC HEATER WITH AN OVERHEAT SAFETY DEVICE

The invention is concerned with a tubular heater.

From the EP 00 86 465, a tubular heater is known that comprises a heater coil made of resistance wire, and which is housed in a tubular jacket embedded in insulating material. Into the end of the tubular jacket, a piece of tubing is inserted that is insulated in relation to the tubular jacket and in which a device for protection against overheating is housed in the form of a "PTC"-element, of a heat sensor, of a safety fuse, or of a thermostat. The piece of tubing is connected with the heater coil in direct heat conductance. The protection from overheating is a device that is inserted from the outside and is interchangeable.

The housing of a safety member in the form of a safety fuse, of a thermostat, or of a heat sensor in the end of the tubular heater has the great advantage that a direct heat input to the heating coil exists, so that a rise of temperature of the coil will reach the safety member very rapidly.

Inasmuch as the safety member is positioned outside the heated part of the tubular heater, the pertinent area of the tubular jacket does not calcify any longer, in the case of water heating, so that, independently of the degree of any other calcification of the tubular heater, a defined heat transfer and, accordingly, a defined response of the safety member will be achieved.

But, it is difficult to design safety members such as, e.g., thermostats that, can be housed in the limited space of a few millimeters of the end of the tubular heater, but despite that fact, ensure a dependable switching operation in the case of the general operating voltage of 220 V. Accordingly, in practice, only safety fuses have been successful. But, they have the disadvantage that the switching off of the tubular heater takes place by way of one single voltage pole. In a short-circuit of the heating coil to the jacket of the tubular heater at a certain spot in the extent of the tubular heater, current flows through the heating coil despite the unipolar switching off, namely, as a consequence of the lower resistance of the heating coil that arises from the shortening of the length of the heating coil under voltage, combined with a relatively high heating performance and corresponding danger of fire.

Likewise, the use of PTC-elements in the end of the tubular heater did not find acceptance in the field of household appliances, since these circuits do not have the appropriate dependability and precision of response.

In addition, alloys with the capability of storing data on shapes (forms), so-called "memory alloys" are known, e.g., from Technische Mitteilungen, Krupp Forschungsberichte, v. 34 (1976), #1, they are marketed under the "NITINOL" trademark.

Accordingly, the invention is based on the problem of improving the reliability and response-characteristic of an excess temperature protection device for a tubular-heater system of the type in question, to make a bi-polar switch-off possible, and to lower the cost of the protective member and of exchanging said member considerably.

Figure 2:
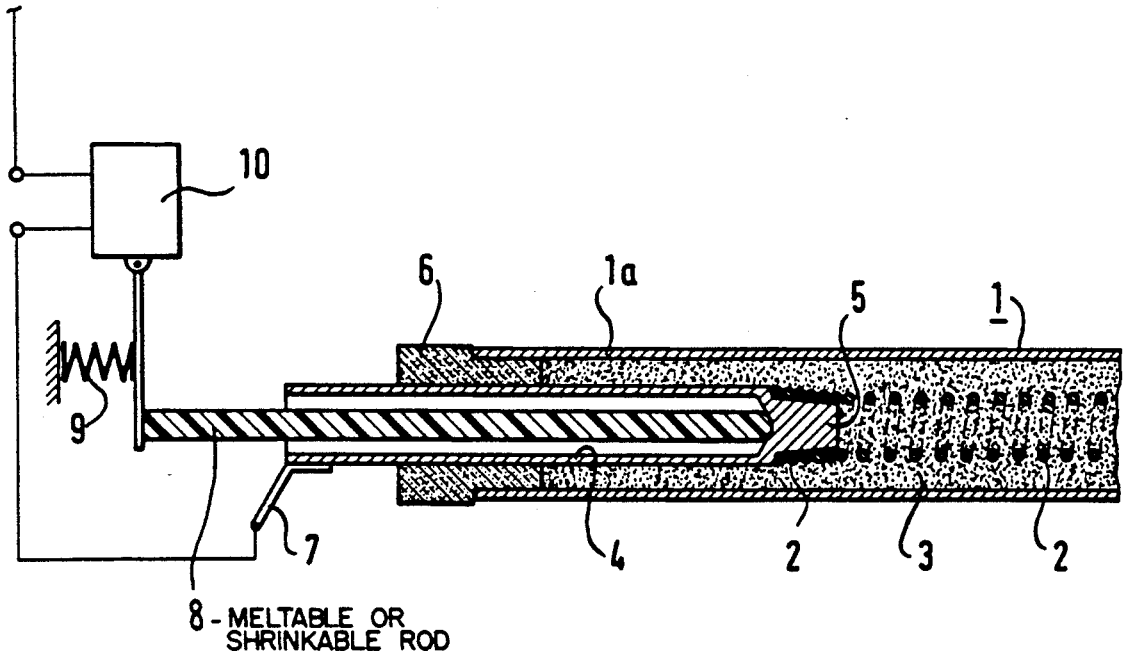
Figure 5:
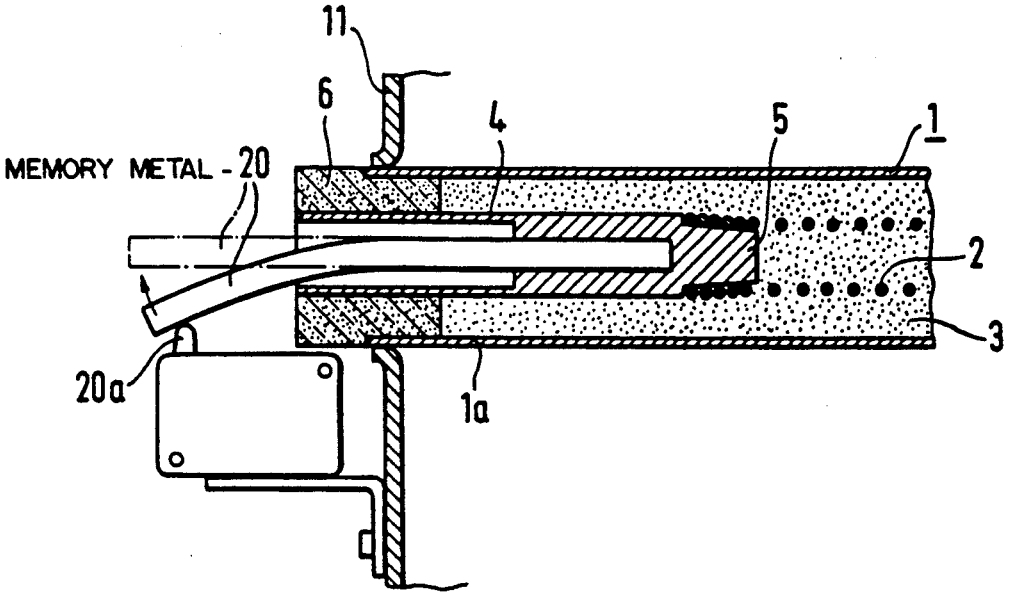
Figure 6:
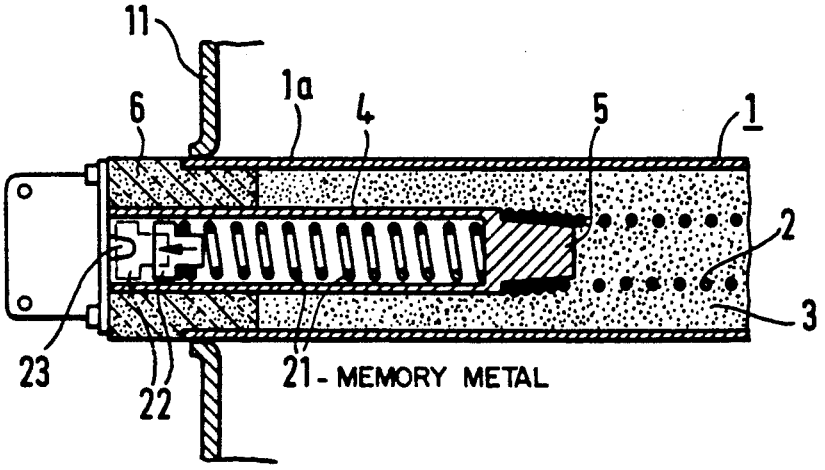
Figure 7:
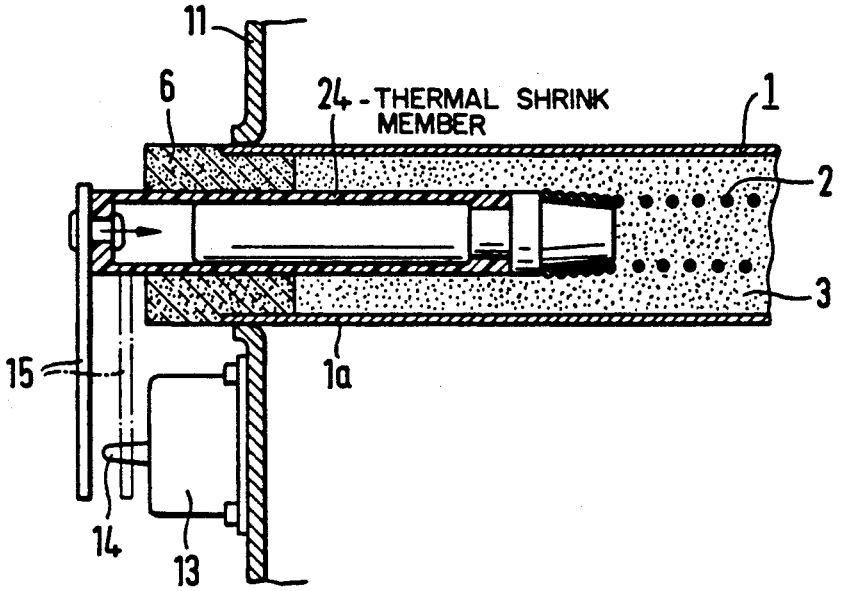
Figure 8:
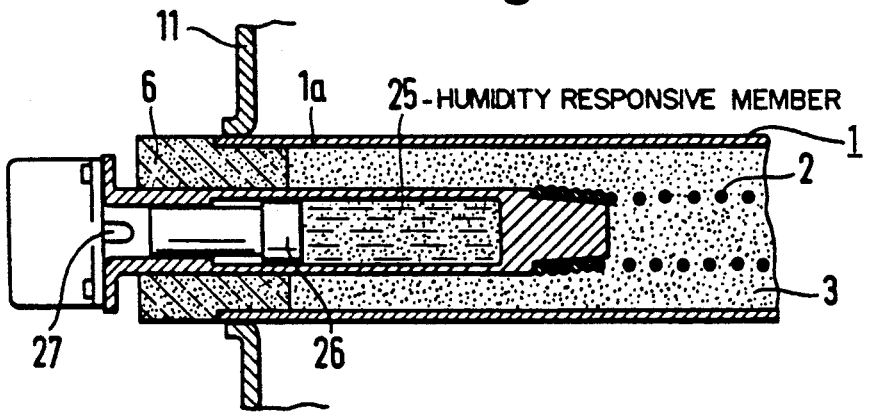
Figure 9:
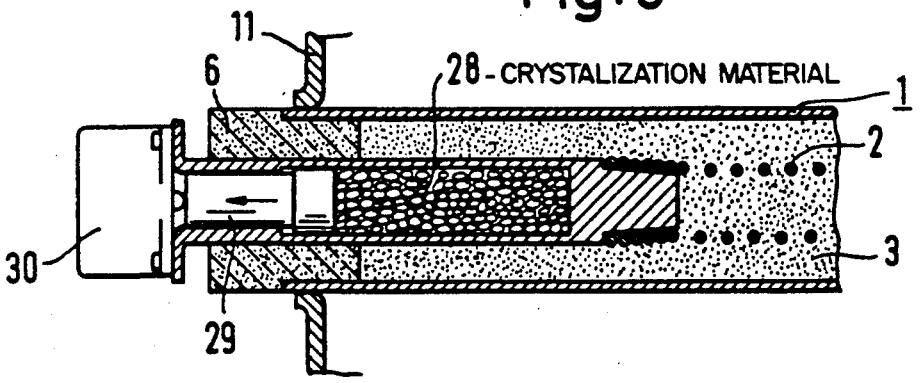
Figure 10:
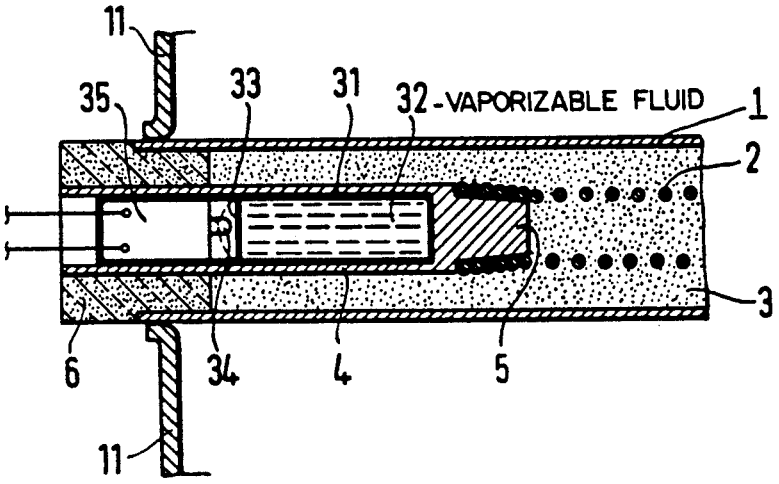
Figure 11:
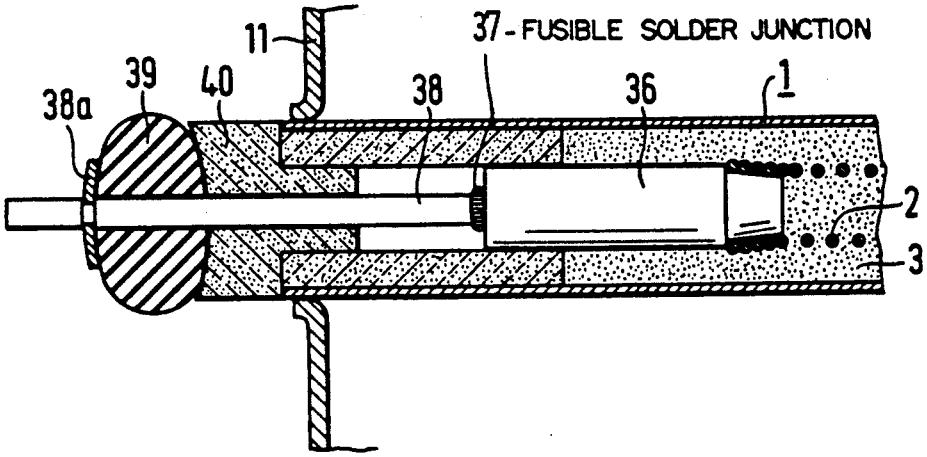
Figure 12:
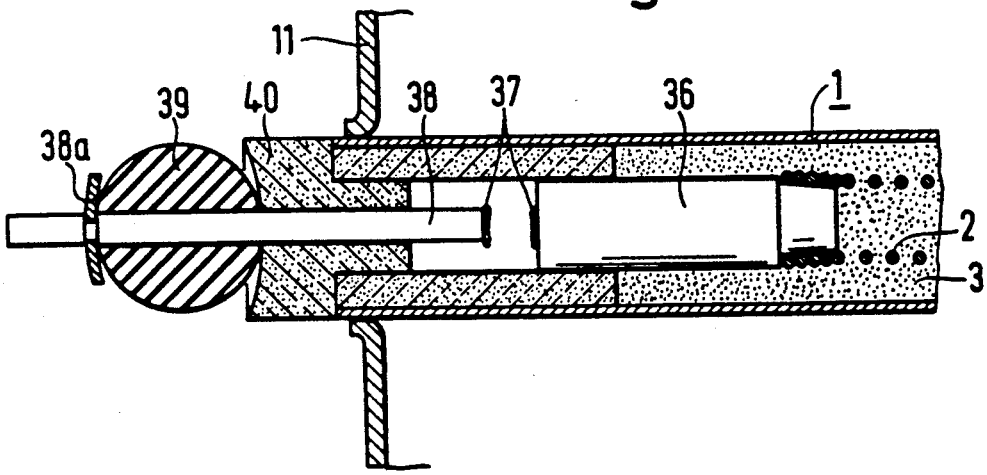
Figure 13:
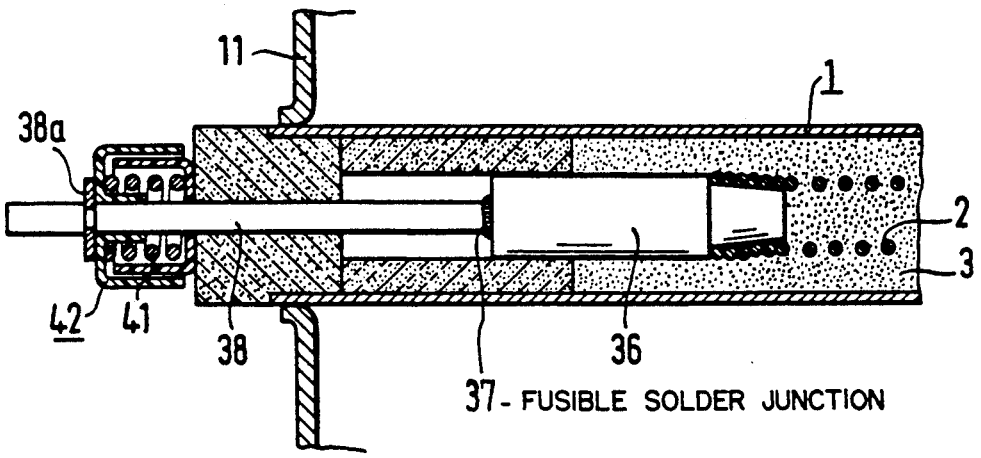
Figure 14:
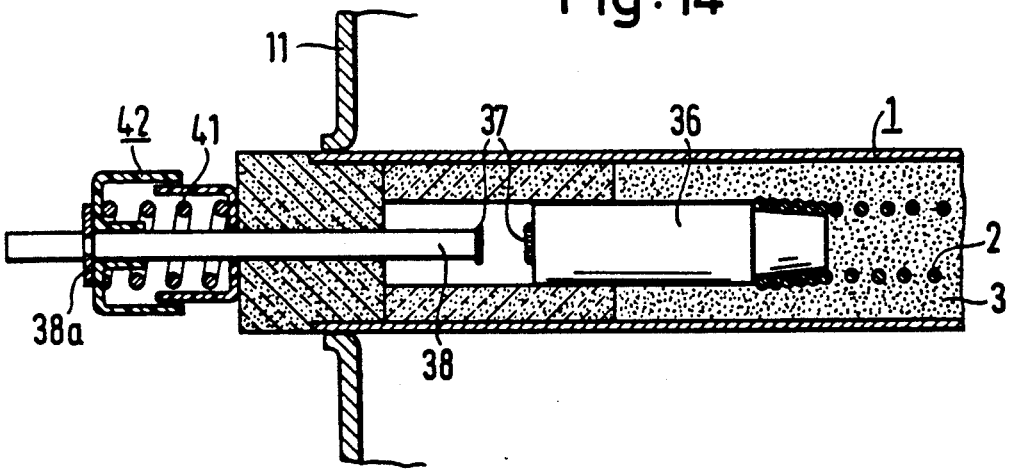

The enclosed drawings serve further to explain the object of the invention. There are shown in FIG. 1 a view of a U-shaped tubular heater with pertinent flange plate;

FIG. 2 a schematic section through the end of a tubular heater comprising a rod-shaped safety member;

FIG. 3 a section along the line III—III in FIG. 1 on a larger scale;

FIG. 4 on an even larger scale, the view of a section along the line IV—IV in FIG. 3;

FIG. 5 a schematic section through the end of the tubular heater comprising a rod-shaped safety member made of memory metal;

FIG. 6 a section similar to FIG. 5, in which the safety member is a helical coil made of memory metal;

FIG. 7 a section similar to FIGS. 5 and 6 in which the safety member is a shrinking hose;

FIG. 8 similar to FIG. 7, in which the safety member is a humidistat;

FIG. 9 a sectional view in which the safety member contains a salt filling;

FIG. 10 a safety element controlled by steam pressure;

FIG. 11 an embodiment of the invention comprising a soldered junction that responds to the melting temperature;

FIG. 12 the embodiment in accordance with FIG. 11, after response of the safety member and bursting of the soldered junction;

FIGS. 13 and 14 an embodiment presenting a variation of FIGS. 11 and 12.

With reference to FIG. 2, a tubular heater consists of a jacket tube 1 in which a heating coil 2 is housed, embedded in insulating material 3.

In the end region la of the tubular heater which is not heated by the heating coil, a piece of tubing 4 is inserted that is surrounded by insulating material 3, over at least part of its length. The heating coil 2 is welded on the conically tapering end 5 of the piece of tubing 4. In addition, the piece of tubing 4 is held by a terminal bead 6.

Inasmuch as the piece of tubing 4 is connected electrically with the heating coil 2, it serves as terminal pole 7. Since the terminal area 1*a* of the tubular jacket is not heated by the heating coil 2, it cannot calcify, so that the result is a heat transfer that is constant during the entire operating period of the tubular heater, and that flows from the heating coil 2 by way of the welded joint on the conical end 5 to the piece of tubing 4 and, concentrically, through the insulating material 3 onto the unheated area 1*a*. This heat flow remains, independently of the position in which the tubular heater is mounted, the same at all times, due to the concentric heat transfer. Accordingly, during normal operation, a constant temperature will prevail in the piece of tubing 4. Now, a rod 8 is inserted into the piece of tubing 4; it is pressed by a spring 9 of a switching system 10 against the inner bottom of the piece of tubing 4.

The rod 8 is made of a plastic material that, at a certain temperature, melts or changes its structure, e.g., shrinks. That temperature is somewhat higher than the temperature that occurs in the tube 4 in the case of normal operation. When the temperature of the tubular heater rises excessively, e.g., when it becomes dry due to lack of water or to being covered or to excessive calcification, the temperature in the piece of tubing 4 rises. The end of rod 8 that projects into the piece of tubing 4 starts melting, while the spring 9 turns the movable contact of the switching system 10. Accordingly, the switching system 10 cuts off the supply of current to the heating coil 2.

The ends of the tubular heater 1 are positioned, in the form of embodiment of the invention as shown in FIG. 1, wherein a flange 11 that closes an opening in the wall of the shell 12. The flange 11 supports a switching system 13 that is common to both ends of the tubular heater; the switch actuator 14 of the switching system 13 is bridged by a rod 15 that engages the rods 8. When the rods 8 are made of a melting material, a spring (not shown) is provided that presses on the rod 15. When one of the rods 8 melts, the actuator 14 of the switching system 13 is pushed inwardly, and the supply of current to the two tubular heaters accordingly is interrupted.

In the design shown in FIGS. 3 and 4, a snap disc 16 is provided on which a piston 17 is acting. A member 18 that expands strongly at the critical temperature acts on the piston 17 against the initial tension of the snap disc 16. When the temperature exceeds a certain limit, the snap disc passes—as shown in FIG. 4 by dotted lines—its critical center of gravity and snaps out, while the actuator 14 of the switching system 13 is opened by way of the rod 15.

This design has the special advantage that a "sticking" of the terminal is prevented. A very high response-precision is the result.

The snap disc 16 may be made of a metal alloy or of a bimetal, so as to achieve the highest response-precision characteristic possible. In the design shown, the snap disc is schematically integrated in the end of the tubular heater. The snap disc may, of course, be mounted at another location of the flange 11; e.g., it may take the place of the terminal 14 in the switching system 13, or be combined with it.

In the design as shown in FIGS. 5 and 6, use is made of the "memory effect" of certain metals. Memory metals are alloys, e.g., containing 52 to 57% of nickel, a few percent of cobalt, with the balance being titanium. The metals are worked at low temperatures. At a certain equilibrium temperature that, in the case of a titanium content of approximately 46%, lies at 120° C., the memory metal will assume its original form. Consequently, this range is extremely favorable for the present purpose.

In accordance with the design as shown in FIG. 5, a rod 20 made of memory metal is inserted into the piece of tubing 4; the rod has been bent at a low temperature. When the equilibrium temperature of 120° is reached, the rod 20 reassumes its original straight form and releases a contact mechanism 20*a*. Of course, it is also possible to follow the reverse path, i.e., that a curved rod is produced that is straightened at a low temperature. This rod is bent at the equilibrium temperature and actuates an appropriate contact mechanism.

In the embodiment of the invention as shown in FIG. 6, a helical spring 21 made of memory metal is inserted into the tube 4. When the equilibrium temperature is reached, the wire of the helical spring 21 attempts to reassume its original straight shape, i.e., it expands. Thereby, a piston 21 is pressed on the contact mechanism 23. In the design as shown in FIG. 7, a hose-shaped member 24 made of a shrinkable material is used. When the critical temperature is reached, the material shrinks. The hose 24 will then actuate, by way of a rod 15, a contact mechanism 14 of the circuit 13. In the case of these shrinking foils or shrinking hoses, the memory of plastic materials for their state before deformation is used. We have to do with cold-stretched thermoplastic plastic foils on the basis of PETP, PE, PVC that contract, when heat-treated, to their original state. The shrinking hoses may be slid on a rod, and, on their front end, a ring gliding upon it may be mounted that, e.g., actuates the switching system by way of a connecting wire.

In FIG. 8, a humidistat ("device controlling the expansion of humidity") 25 is shown. It actuates a piston 26. An elastic, rubber-like material may be substituted for the piston 26. When the admissible temperature in the tube 4 is exceeded, a contact mechanism 27 is actuated by the piston 26.

In the embodiment of the invention as shown in FIG. 9, the effect of recrystallisation or of the growth of crystals is utilised. Once more, a salt filling 28 acts upon a piston 29 that actuates the contact mechanism of a switching system 30. This means that the effect of the recrystallisation or of the growth of seed crystals at a certain temperature is utilised. It is also possible to make use of certain volatile chemical compounds in a tube with a piston, or in a tube the jacket of which is ductile, e.g., is made of an elastic rubber-like material. As a result of heating, the vapor pressure in the tube rises, until it overcomes the resistance of the snap disc 16, whereby the contact mechanism is actuated.

In the design of FIG. 10, a switching system that comprises, in an elastic jacket 31, a fluid 32 that boils at approximately 120° C. is inserted into the tube 4. According to the vapor fluid equilibrium, the membrane 33 buckles and assumes the form suggested by the dotted line, when the temperature rises above the critical value; a contact mechanism 34 actuates a circuit 35.

In the design of FIGS. 11 and 12, a cylindrical metallic body 36 has been provided; the heating coil 2 is welded to it. A rod 38 that leads toward the outside, is soldered to the front surface of the metallic body 36 by means of a soldered junction 37. The rod 38 passes through the inner bore of an insulating bead 40 that closes the tubular heater. The insulating bead 40 has, on its frontal surface, a trough-like recess, so that it can take-up a spherical rubber bead 39 that is held, in a compressed state, by a disc 38*a* which is spread on the rod 38. The rod 38 also serves to supply power to the heating coil 2. If, due to excessively high temperature, e.g., when a temperature of 150° C. is exceeded, the soldering junction 17 is torn apart, the tension of the elastic sphere 39 is released, so that the supply of power to the heating coil 2 will be interrupted, as shown in FIG. 12.

In the design of FIGS. 13 and 14, the rubber sphere 39 has been replaced by a helical spring 41 which is housed in a casing 42 that consists of two box-shaped parts that slide into one another. In all other respects, the mode of action is the same as in the design in accordance with FIGS. 11 and 12.

It is advantageous to have both connections of the tubular heater switched off upon any response of the circuit 10.

The reason is this: When overheating is due to a burning through of the tubular heater, i.e., to arcing between the heating coil 2 and the tubular heater 1, the arc will continue burning when power is supplied by the other connection of the tubular heater. This means also that the water filling of the device is alive, with corresponding risks for the operator.

In tubular heaters operated with polyphase alternating current, it would be useful to have all connections switched off when the switching system 10 responds.

The particular advantage of the new overload protection is to be found in the fact that rod 8 can be exchanged very easily, and that it costs considerably less than a safety fuse or a bimetal switch. The rod has, generally, a length of 3 to 5 cm and a diameter of 3 mm. Its fusing temperature may lie, in appliances in which the tubular heater is used to heat water, viz., e.g., in washing machines, dishwashers, coffee percolators or similar devices, close to 150° C., i.e., at a temperature that is not exceeded as long as the tubular heater is water-cooled, but at which on the other hand all risk of a fire is excluded. The plastic material of rod 8 can be adapted precisely to the various applications of the tubular heater.

When a tubular heater which is already completed is needed for another purpose, suitably different rods 8 are inserted. In contrast to tubular heaters in which, e.g., fuses are provided within the body run of a tubular heater that are no longer exchangeable after they have been manufactured, it is ensured in this way that appropriately large series can be produced which then will be distributed in accordance with the various types of appliances.

The rod 8 may be one continuous metal or alloy that fuses at the response temperature. Further, it may be a fundamental substance on which a metal tip has been placed that fuses at the response temperature. This development has the advantage that, for appropriate adaptation of a tubular-heater series to a certain use, it is necessary only to attach the suitable metal tips.

I claim:

1. A tubular heater comprising:

a tubular sheath, an electric heater coil enclosed within said tubular sheath, a cavity within said tubular sheath, a safety device for turning off power to said electric heater coil of said tubular heater when the tubular heater overheats, said safety device including an electrically conductive tube in said cavity having said electric heater coil electrically connected to one end of said tube and extending away from said tube through said tubular sheath, a rod-shaped member made of a material which is thermally deformable at a certain temperature, said rod-shaped member being located in said tube and extending from said one end of said tube along a length of said tube and said rod-shaped member projecting from an open end of said tube, a normally closed switching arrangement located externally of said tubular sheath and connected in series with said tube and arranged to be actuated by movement of said rod-shaped member projecting from the open end of the tube due to the rod-shaped member undergoing deformation at the certain temperature so that the rod-shaped member acts upon said switching arrangement to turn off said heater coil of said tubular heater, said rod-shaped member in said tube being affected by excessive temperatures of said heater coil.

2. Tubular heater in accordance with claim 1, wherein the rod-shaped member is made of a memory-alloy.

* * * * *